US006074314A

United States Patent [19]

DeGaris

[11] Patent Number: 6,074,314

[45] **Date of Patent: *Jun. 13, 2000**

[54] COUNTERWEIGHT BALANCING SYSTEM FOR GAME RACQUETS

[75] Inventor: Kenneth Godfrey DeGaris, Carlingford, Australia

[73] Assignee: Head Sport AG, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,527

[22] Filed: Apr. 7, 1998

Related U.S. Application Data

[63] Continuation-in-part of application No. 08/586,801, filed as application No. PCT/AU94/00446, Aug. 5, 1994, abandoned.

[30] Foreign Application Priority Data

Aug. 5, 1993 [AU] Australia ..... PM-0384

[51] Int. Cl.[7] ..... A63B 49/02

[52] U.S. Cl. ..... 473/537

[58] Field of Search ..... 473/537, 524

[56] References Cited

U.S. PATENT DOCUMENTS 4,291,574 9/1981 Frolow ..... 473/537 X 5,110,126 5/1992 Kuebler ..... 473/537

FOREIGN PATENT DOCUMENTS 2933299 3/1981 Germany ..... 473/FOR 171

*Primary Examiner*—Raleigh W. Chiu

*Attorney, Agent, or Firm*—Finnegan, Henderson, Farabow, Garrett & Dunner, L.L.P.

[57] ABSTRACT

A game racquet for tennis, racquetball, squash and the like, includes a handle having a free end and a racquet head defined by an open loop frame and having no weight heads. A throat connects the racquet head to the handle at an end of the handle opposite the free end thereof, with the open loop frame of the racquet head having a first half remote from the handle and a second half in closer proximity to the handle. A mid-section of the game racquet extends from, and includes, the second half of the open loop frame and the throat, to a point approximately 20 centimeters from the free end of the handle, with the weight of the mid-section of the game racquet being 25%, or less, of the total weight of the game racquet, when in an unstrung condition. In an alternative embodiment, the game racquet includes defining a portion of a closed loop frame of the racquet head. In this embodiment, the mid-section of the game racquet extends from, and includes, the second half of the closed loop frame and the throat, to a point approximately 21 centimeters from the free end of the handle, with the weight of the mid-section of the game racquet being 25%, or less, of the total weight of the game racquet, when in an unstrung condition.

8 Claims, 4 Drawing Sheets

COUNTERWEIGHT BALANCING SYSTEM FOR GAME RACQUETS

CROSS-REFERENCE TO RELATED APPLICATION

This is a continuation-in-part of application Ser. No. 08/586,801, filed Oct. 21, 1996, now abandoned, which is the U.S. National Phase of P.C.T. International Application No. PCT/AU94/00446, filed Aug. 5, 1994.

BACKGROUND OF THE INVENTION

1. Technical Field of the Invention

The present invention relates to a game racquet and, in particular, to a game racquet which is able to accommodate either a fixed or flexible counterweight balancing system of large proportion, which operates outside a deemed mid-section of the racquet.

Further, although the following description refers primarily to tennis racquets, the invention is not limited thereto. Other games racquets such as squash and racquetball racquets having the inventive facility herein are also envisaged.

2. Description of the Prior Art

Counterweight balancing systems have not been used in the manufacture of game racquets such as tennis racquets. Game racquets, such as that disclosed by Frolow, U.S. Pat. No. 4,291,574, issued Sep. 29, 1981, have simply had their points of balance adjusted to reflect a slightly head heavy, head light or neutral feel for the user.

SUMMARY OF THE INVENTION

It is, therefore, an object of the present invention to provide a game racquet which is able to accommodate either a fixed or flexible counterweight balancing system of large proportion, which operates outside a deemed mid-section of the racquet.

The inventor has discovered that superior game racquet performance characteristics, such as increased power and control, better balancing and a lighter swing weight than would be achievable with conventional tennis racquets, etc., can be achieved over the normal performance characteristics of existing racquets.

In addition, game racquets with a counterweight balancing system, of the type toward which the present invention is concerned, which are of large proportion, will also exhibit self-generating racquet head speed, a bigger sweet spot and greatly reduced racquet vibration and shock upon impact with a ball which, in turn, reduces the occurrence of arm and related injuries.

These advantages can be accomplished by means of the present invention described herein and are not otherwise achievable via prior art game racquets. Thus, it has been found advantageous to provide a game racquet, which has a counterweight balancing system of large proportion, in which a major proportion of the weight of the racquet, when calculated prior to having the racquet strung, is distributed in either fixed or varying proportions near opposite ends of the racquet.

The present invention has, therefore, been conceived out of the need to provide a counterweight balancing system of large proportion in order to obtain a useful arrangement of a game racquet, which provides superior performance characteristics.

According to one aspect of the present invention there is provided a tennis racquet comprising:

a handle having a free end;

a racquet head defined by a closed loop frame;

a bridge that defines a portion of the closed loop frame of the racquet head; and, a throat connecting the racquet head to the handle, and the closed loop frame having a first half remote from the handle and a second half that includes the bridge being closer to the handle;

wherein a mid-section of the racquet extends from and includes the second half of the closed loop frame and the throat, to a point approximately 21 centimeters from the free end of the handle, characterized in that the weight of the entire of the mid-section of the racquet, when unstrung, represents twenty-five percent (25%) or less of the total weight of the unstrung racquet.

According to another aspect of the present invention there is provided a squash racquet comprising:

a handle having a free end;

a racquet head defined by a closed loop frame;

a bridge that defines a portion of the closed loop frame of the racquet head; and, a throat connecting the racquet head to the handle, and the closed loop frame having a first half remote from the handle and a second half that includes the bridge being closer to the handle, wherein a mid-section of the racquet extends from and includes the second half of the closed loop frame and the throat, to a point approximately 21 centimeters from the free end of the handle, characterized in that the weight of the whole of the mid-section of the racquet when unstrung represents twenty percent (20%) or less of the total weight of the unstrung racquet.

According to a further aspect of the present invention there is provided a racquetball racquet comprising:

a handle having a free end;

a racquet head defined by a closed loop frame;

a bridge that defines a portion of the closed loop frame of the racquet head; and, a throat connecting the racquet head to the handle, and the closed loop frame having a first half remote from the handle and a second half that includes the bridge being closer to the handle, wherein a mid-section of the racquet extends from and includes the second half of the closed loop frame and the throat, to a point approximately 21 centimeters from the free end of the handle, characterized in that the weight of the whole of the mid-section of the racquet when unstrung represents twenty percent (20%) or less of the total weight of the unstrung racquet.

According to a still further aspect of the present invention there is provided a tennis racquet comprising:

a handle having a free end;

a racquet head defined by an open loop frame;

a throat connecting the racquet head to the handle, and the open loop frame having a first half remote from the handle and a second half closer to the handle, wherein a mid-section of the racquet extends from and includes the second half of the open loop frame and the throat, to a point approximately 20 centimeters from the free end of the handle, characterized in that the weight of the whole of the mid-section of the racquet when unstrung represents twenty-five percent (25%) or less of the total weight of the unstrung racquet.

According to a still further aspect of the present invention there is provided a squash racquet comprising:

a handle having a free end;

a racquet head defined by an open loop frame; and, a throat connecting the racquet head to the handle, and the open loop frame having a first half remote from the handle and a second half closer to the handle, wherein a mid-section of the racquet extends from and includes the second half of the open loop frame and the throat, to a point approximately 20 centimeters from the free end of the handle, characterized in that the weight of the whole of the mid-section of the racquet when unstrung represents twenty percent (20%) or less of the total weight of the unstrung racquet.

According to a still further aspect of the present invention there is provided a racquetball racquet comprising:

a handle having a free end;

a racquet head defined by an open loop frame;

a throat connecting the racquet head to the handle, and the open loop frame having a first half remote from the handle and a second half closer to the handle, wherein a mid-section of the racquet extends from and includes the second half of the open loop frame and the throat, to a point approximately 20 centimeters from the free end of the handle, characterized in that the weight of the whole of the mid-section of the racquet when unstrung represents twenty percent (20%) or less of the total weight of the unstrung racquet.

Preferably, the mid-section of the various game racquets of the present invention includes a portion of the handle and/or a shaft between the throat and the handle.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
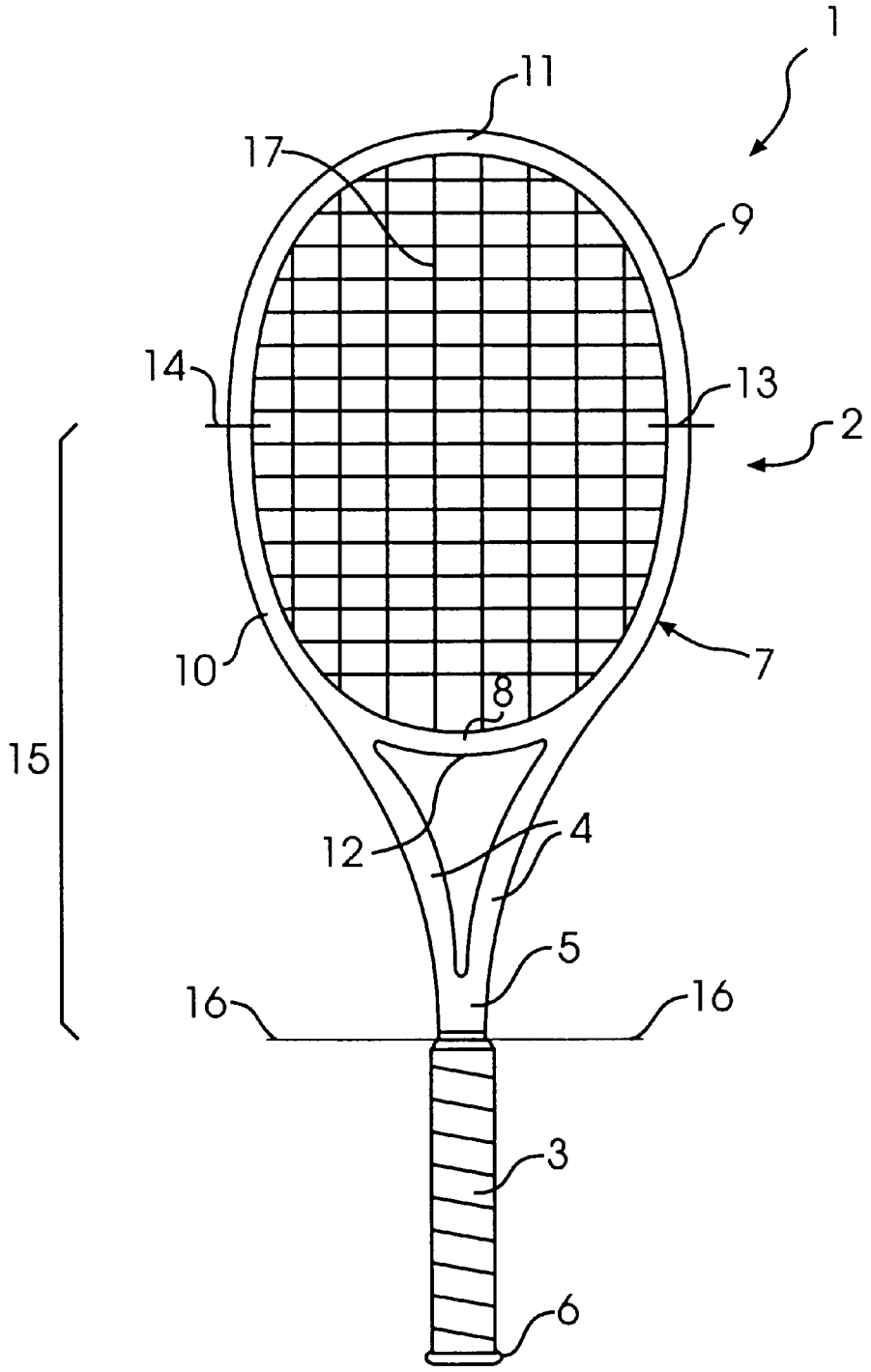
FIG. 1 is a face view of a game racquet of a first embodiment in accordance with the present invention.

Turning now, in detail, to an analysis of the accompanying drawing figures, a tennis racquet 1 of a first embodiment of the invention is illustrated in FIG. 1. The racquet 1 has a racquet head 2 connected to a handle 3 by a throat 4 and shaft 5; with shaft 5 being connected to handle 3 and two members of the throat 4 being connected between the shaft 5 and the racquet head 2. Handle 3 has a butt 6 at its free end. Racquet head 2 comprises a closed loop frame 7, which has a bridge 8 as a portion of the closed loop frame 7. Bridge 8 forms the portion of closed loop frame 7 between the connection points of the two members of throat 4.

Racquet head 2 can be divided into two halves with a top half 9 being remote from handle 3 and with the lower half 10 being closer to handle 3. The lower half 10 includes bridge 8. The two halves 9, 10 can be visualized by identifying the tip 11 or the twelve-o'clock position, at the top of racquet head 2; and the base 12 or six-o'clock position, at the base of racquet head 2. By visualizing a line drawn between the tip 11 and base 12, and by dividing it into two halves, a three-o'clock point 13 and a nine-o'clock point 14 can be identified and the two halves 9, 10 are determined.

Figure 3:
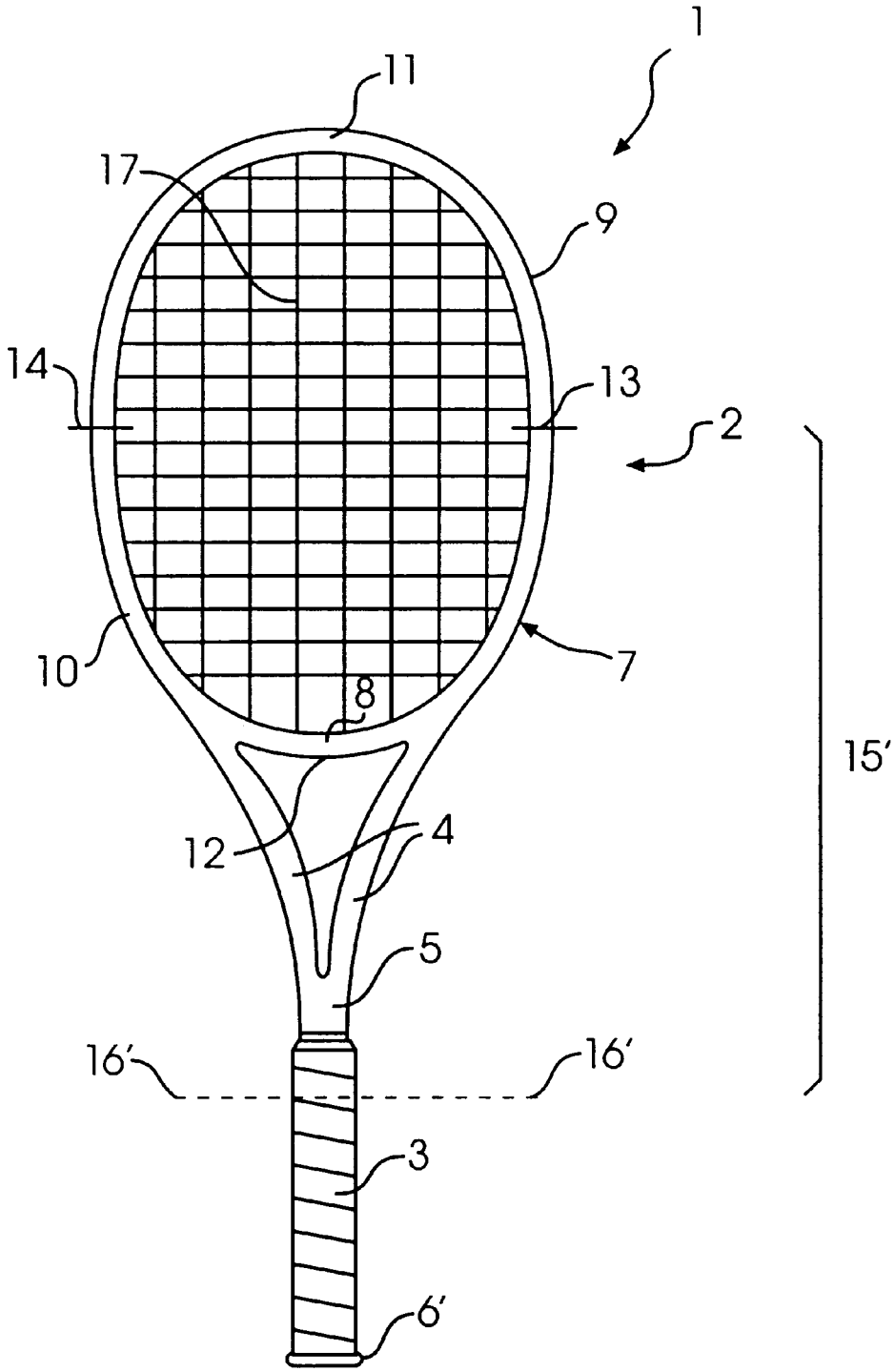
FIG. 3 is a face view of a game racquet of a third embodiment in accordance with the present invention; and, FIG. 4 is a face view of a game racquet of a fourth embodiment in accordance with the present invention.

A "mid-section" 15 of racquet 1 is defined as being that section of racquet 1 which extends between a line between the points 13 and 14, on the one hand, and a point 16, which is approximately 21 centimeters up handle 3 from its free end having butt 6. In an alternative embodiment of the invention shown in FIG. 3, the mid-section 15' may include a portion of handle 3, and extend between a line defined between the points 13 and 14, and a point 16'. In this alternative embodiment, the overall dimensions of racquet 1 are adjusted accordingly so that point 16' is, preferably, approximately 21 centimeters up handle 3 from its free end having butt 6'. Therefore, the mid-section 15 of racquet 1 of the embodiment, as illustrated in FIG. 1, comprises the lower half 10 of racquet head 2, throat 4, shaft 5 and bridge 8. It is noted that other tennis racquets (not illustrated), which may have different length handles, such as a racquet which is used by a double-handed backhand player, can include a portion of its handle within the mid-section 15.

The tennis racquet 1 of this first preferred embodiment is constructed such that the weight of the mid-section 15 represents approximately twenty-five percent (25%) or less of the total weight of racquet 1 when racquet 1 is unstrung. The remainder of the weight of racquet 1 can be distributed in fixed or varying proportions near the opposite ends of racquet 1 to obtain the desired performance characteristics. Racquet 1 is illustrated with strings 17, for the purpose of showing a complete article. The weight proportions provided herein, however, are based upon the weight of racquet 1 when it is unstrung.

Figure 2:
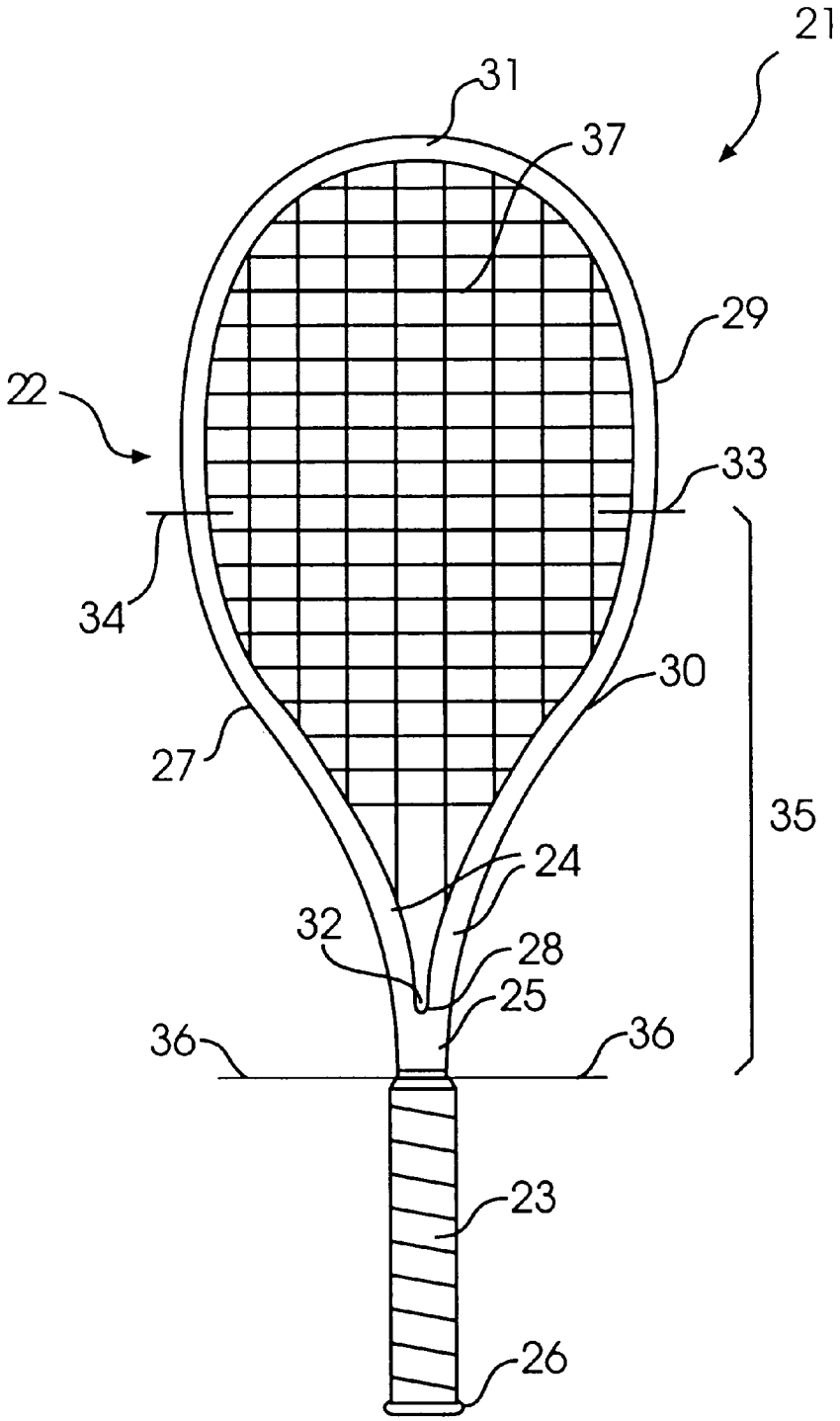
FIG. 2 is a face view of a game racquet of a second embodiment in accordance with the present invention.

A tennis racquet 21 of a second embodiment is illustrated in FIG. 2. Racquet 21 has a racquet head 22, comprising an open loop frame 27 and a throat 24, which is connected to a shaft 25 at its top section 28. Shaft 25, in turn, connects to a handle 23, which has a butt 26 at its free end. Throat 24 comprises two members which are extensions of the open loop frame 27, and which are joined at the top section 28 of shaft 25. In this embodiment, there is no bridge portion corresponding to the bridge 8 of the first embodiment, as racquet 21 takes the shape of a "tear drop".

Like the first embodiment, racquet head 22 can be divided into two halves with the top half 29 being remote from handle 23 with the lower half 30 being closer to handle 23. The two halves 29 and 30 can be visualized by identifying the tip 31 or the twelve-o'clock position, at the top of racquet head 22; and base 32 or six-o'clock position, at the top section 28 of shaft 25. By visualizing a line drawn between the tip 31 and base 32, and by dividing it into two halves, a three-o'clock point 33 and a nine-o'clock point 34 can be identified and the two halves 29 and 30 are determined. In this embodiment, the lower half includes the throat 24 of the racquet 21.

Figure 4:
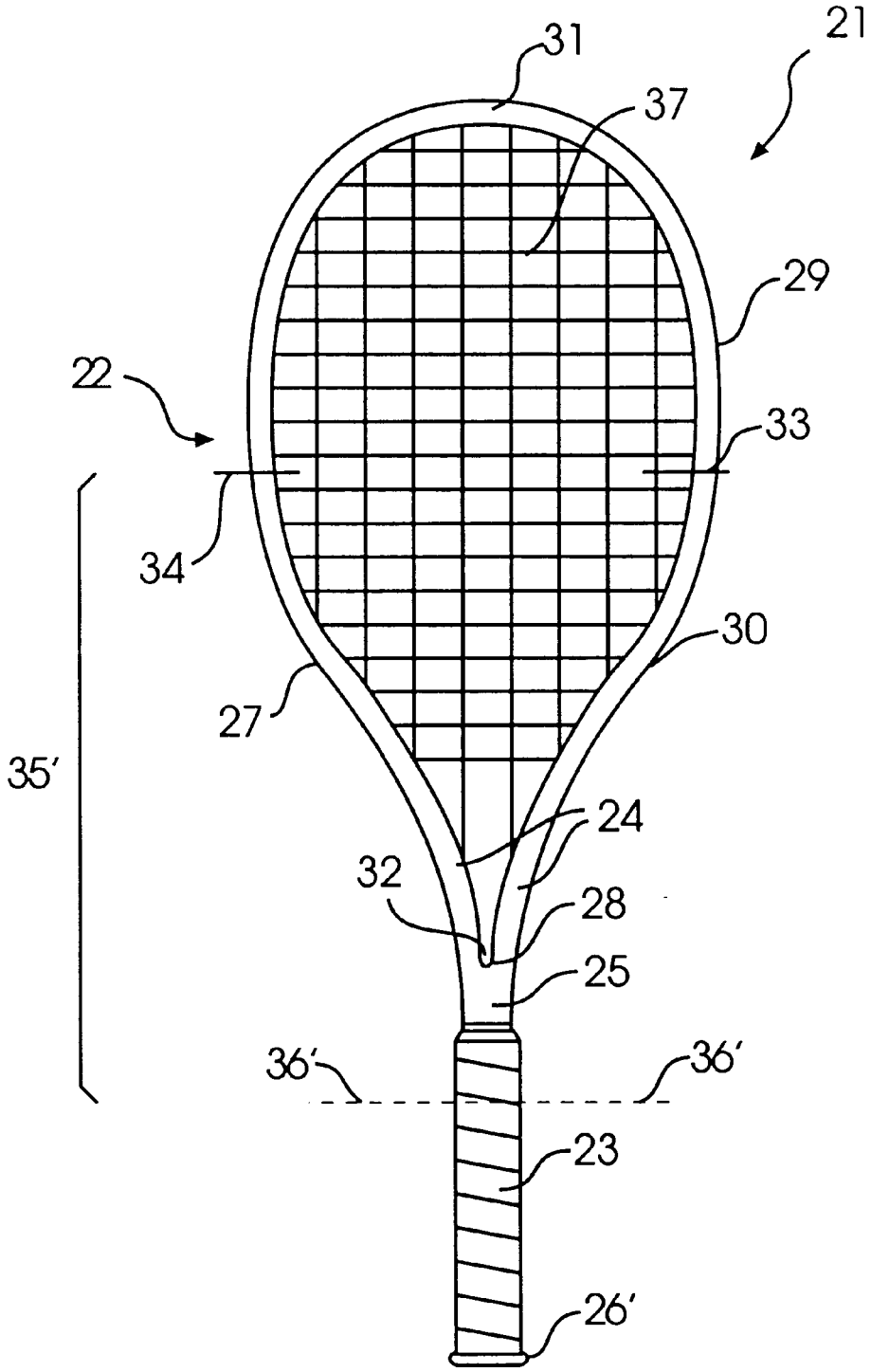

A "mid-section" 35 of racquet 21 is defined as being that section of racquet 21 which extends between a line between the points 33 and 34, on the one hand, and a point 36, which is approximately 20 centimeters up handle 23 from its free end having butt 26. In an alternative embodiment of the invention shown in FIG. 4, the mid-section 35' may include a portion of handle 23, and extend between a line defined between the points 33 and 34, and a point 36'. In this alternative embodiment, the overall dimensions of racquet 21 are adjusted accordingly so that point 36' is, preferably, approximately 20 centimeters up handle 23 from its free end having butt 26'. Therefore, the mid-section 35 of racquet 21 of the embodiment as illustrated in FIG. 2 comprises the lower half 30 of racquet head 22 (including the throat 24) and the shaft 25. It is noted that other tennis racquets (not illustrated) which may have different length handles, such as a racquet which is used by a double handed backhand player, can include within the mid-section 35 a portion of its handle.

Tennis racquet 21 of this second preferred embodiment is constructed such that the weight of the mid-section 35 represents approximately twenty-five percent (25%) or less of the total weight of racquet 21 when racquet 21 is unstrung. The remainder of the weight of racquet 21 can be distributed in fixed or varying proportions near the opposite ends of racquet 21 to obtain the desired performance characteristics in a similar manner to the first embodiment. Racquet 21 is illustrated with strings 37, for the purpose of showing a complete article. The weight proportions provided herein, however, are based upon the weight of racquet 21 when it is unstrung.

It is noted that the distribution of the weight of the racquets 1 and 21 can be achieved by reducing the weight of the mid-sections 15 and 35 by using lighter and stronger materials, such as titanium or titanium/ceramic compounds in the frame of the tennis racquets 1 and 21.

The present invention allows for some flexibility in weight distribution outside the defined mid-sections 15 and 35 to enable a variety of differently weight distributed racquets to operate within the scope of the present invention. The present invention is not limited to any specific counterweight balancing system that can be used within the parameters of the distribution of weight of the racquet as defined.

The foregoing discussion describes only two embodiments of the invention and modifications obvious to those skilled in the art can be made thereto without departing from the scope of the present invention.

For example, the present invention has been described with respect to tennis racquets only, however, the invention is equally related to squash and racquetball racquets. The invention has not been described with respect to squash and racquetball racquets as the description would be replicated, except that the percentage weight of the mid-section of the squash and racquetball racquets represents approximately twenty percent (20%) or less of the total weight of racquets 1 and 21 when racquets 1 and 21 are unstrung due to different dimensions of these types of racquets.

What is claimed is:

1. A game racquet, comprising:

a handle having a free end;

a racquet head defined by a closed loop frame;

a bridge defining a portion of the closed loop frame of said racquet head;

a throat connecting said racquet head to said handle at an end of said handle opposite the free end thereof, with the closed loop frame of said racquet head having a first half remote from said handle and a second half that includes said bridge being closer to said handle, wherein a mid-section of said game racquet extends from, and includes, the second half of the closed loop frame and the throat, to a point approximately 21 centimeters from the free end of said handle, with the weight of the mid-section of said game racquet being 25%, or less, of the total weight of said game racquet, when unstrung;

a racquet counterbalance wherein the first half of the closed loop frame and a racquet portion extending approximately 21 centimeters from the free end of the handle are approximately the same weight; and, a plurality of strings extending horizontally and vertically within the closed loop frame of said racquet.

2. The game racquet according to claim 1, wherein the weight of the mid-section of said game racquet, when unstrung, is 20%, or less, of the total weight of said game racquet.

3. The game racquet according to claim 1, wherein the mid-section includes a portion of said handle.

4. The game racquet according to claim 1, wherein the mid-section includes a shaft between said throat and said handle.

5. A game racquet, comprising:

a handle having a free end;

a racquet head defined by an open loop frame;

a throat connecting said racquet head to said handle at an end of said handle opposite the free end thereof, with the open loop frame of said racquet head having a first half remote from said handle and a second half in closer proximity to said handle, wherein a mid-section of said game racquet extends from, and includes, the second half of the open loop frame and the throat, to a point approximately 20 centimeters from the free end of said handle, with the weight of the mid-section of said game racquet being 25%, or less, of the total weight of said game racquet, when unstrung;

a racquet counterbalance wherein the first half of the open loop frame and a racquet portion extending approximately 20 centimeters from the free end of the handle are approximately the same weight; and, a plurality of strings extending horizontally and vertically within the closed loop frame of said racquet.

6. The game racquet according to claim 5, wherein the weight of the mid-section of said game racquet, when unstrung, is 20%, or less, of the total weight of said game racquet.

7. The game racquet according to claim 5, wherein the mid-section includes a portion of said handle.

8. The game racquet according to claim 5, wherein the mid-section includes a shaft between said throat and said handle.

* * * * *